US009605381B2

(12) United States Patent
Turcotte et al.

(10) Patent No.: US 9,605,381 B2
(45) Date of Patent: Mar. 28, 2017

(54) POCKET VENTILATOR DEVICE AND METHOD

(71) Applicant: ENERQUIN AIR INC., Montréal (CA)

(72) Inventors: Rémi Turcotte, Léry (CA); Jean Desharnais, Kirkland (CA); Nicolas Audet, Ste-Julie (CA)

(73) Assignee: ENERQUIN AIR INC. (CA)

( * ) Notice: Subject to any disclaimer, the term of this patent is extended or adjusted under 35 U.S.C. 154(b) by 0 days.

(21) Appl. No.: 14/863,322

(22) Filed: Sep. 23, 2015

(65) Prior Publication Data

US 2016/0222589 A1 Aug. 4, 2016

Related U.S. Application Data

(60) Provisional application No. 62/109,955, filed on Jan. 30, 2015.

(51) Int. Cl.
*D21F 5/04* (2006.01)

(52) U.S. Cl.
CPC ..... *D21F 5/042* (2013.01)

(58) Field of Classification Search
CPC ..... F26B 13/00; F26B 13/06; D06F 5/042
USPC ..... 34/444, 117; 162/193
See application file for complete search history.

(56) References Cited

U.S. PATENT DOCUMENTS 5,477,624 A * 12/1995 Haessner ..... D21F 5/042 34/117
5,535,527 A * 7/1996 Virta ..... D21F 5/042 162/193
5,560,123 A * 10/1996 Eskelinen ..... D21G 9/0063 34/117
5,860,223 A * 1/1999 Kahl ..... D21F 5/042 34/117
5,864,965 A * 2/1999 Hansson ..... D21F 5/042 34/117
5,887,358 A * 3/1999 Bischel ..... D21F 5/046 34/115
5,987,777 A * 11/1999 Goebel ..... D21G 9/0063 34/114
6,004,430 A * 12/1999 Ilvespaa ..... D21F 3/045 162/207
6,065,222 A * 5/2000 Kuhasalo ..... D21F 5/04 34/117
6,076,280 A * 6/2000 Oechsle ..... D21F 5/042 34/456

(Continued)

FOREIGN PATENT DOCUMENTS

CA 2322112 4/2002
CA 2332677 7/2002

(Continued)

*Primary Examiner* — Stephen M Gravini
(74) *Attorney, Agent, or Firm* — Barnes & Thornburg LLP; Joan T. Kluger

(57) ABSTRACT

A system and a method for ventilating an offset pocket space located in a drying section of a papermaking machine, the offset pocket space being situated between three axially parallel drying cylinders over which a paper web consecutively runs, a first and a third of the drying cylinders being vertically spaced from a second of the drying cylinders, the method comprising creating a positive pressure zone between the body and the felt between the third cleft and the second cleft.

12 Claims, 10 Drawing Sheets

(56) References Cited

U.S. PATENT DOCUMENTS

| | | | | |
|---|---|---|---|---|
| 6,101,735 | A * | 8/2000 | Kuhasalo | D21F 5/04 162/207 |
| 6,412,192 | B1 | 7/2002 | Boucher et al. | |
| 6,513,263 | B2 | 2/2003 | Turcotte | |
| 6,725,569 | B2 | 4/2004 | Turcotte et al. | |
| 8,011,115 | B2 * | 9/2011 | Komulainen | D21F 5/042 131/365 |
| 8,117,765 | B2 * | 2/2012 | Aaltonen | D21F 5/042 162/272 |
| 8,118,977 | B2 * | 2/2012 | Denk | D21F 5/04 162/193 |
| 8,438,754 | B2 * | 5/2013 | Pitkaniemi | D21F 5/042 162/358.5 |
| 2006/0288606 | A1 * | 12/2006 | Thifault | D21F 5/046 34/455 |
| 2016/0222589 | A1 * | 8/2016 | Turcotte | D21F 5/042 |

FOREIGN PATENT DOCUMENTS

| | | | | |
|---|---|---|---|---|
| CA | 2332677 | A1 * | 7/2002 | D21F 5/042 |
| CA | 2369401 | | 7/2002 | |

* cited by examiner

POCKET VENTILATOR DEVICE AND METHOD

CROSS REFERENCE TO RELATED APPLICATIONS

This application claims benefit of U.S. provisional application Ser. No. U.S. 62/109,955, filed on Jan. 30, 2015. All documents above are incorporated herein in their entirety by reference.

FIELD OF THE INVENTION

The invention relates to the art of papermaking and, more particularly, to a ventilation system and method for use in a drying cylinder section of a paper machine.

BACKGROUND OF THE INVENTION

Papermaking is a sophisticated operation involving massive and very expensive machines. These machines are increasingly running at higher speeds, meaning that their overall efficiency must be very high, and in particular, the efficiency of their sub-components must also be very high. The papermaking process requires that water be removed from the initial pulp fiber solution as the paper is formed. The pulp fiber solution, once in the drying section of a papermaking machine, is referred to as the paper web. The paper web is supported as it travels across the machine following a path during which moisture is progressively removed therefrom. The support is provided by endless sheets of porous fabric, felts, wires or other water and gas permeable support means, all of which are generically referred to as the "felt or felts" in the description and appended claims.

The paper web travels from what is referred to as the wet end of the machine to the dry end thereof. In its path, the paper web runs over numerous heated drying cylinders where moisture is evacuated therefrom either by direct evaporation or transfer of moisture to the felts or to the surface of the drying cylinders. A network of ventilator devices is used throughout the drying section in order to inject heated dry air at numerous locations and promote the removal of moisture from the papermaking machine. At the end, the machine outputs the resulting paper, which is then generally reeled to be shipped elsewhere.

Papermaking machines can be built according to numerous possible configurations. One configuration in particular is the twin-wire draw, where the papermaking machine comprises two superposed rows of axially-parallel and horizontally disposed heated drying cylinders. The paper web runs in a serpentine or zigzag path where it defines loops by alternating between the two rows of drying cylinders as it advances along the drying section. The paper web is being supported in most of its path with the assistance of the felts. There is generally one felt for each row of drying cylinders. Each felt presses the paper web on a portion of the surface of the drying cylinders of the corresponding row. Each felt also runs over a felt roll between each pair of adjacent drying cylinders of a same corresponding row. The felt rolls are located deep in the space between the two adjacent drying cylinders. This configuration allows maintaining the paper web in supporting contact with the felt as long as possible. The felt rolls essentially redirect a felt to the next drying cylinder of the same row.

It should be noted at this point that the terms "roll or rolls" and "cylinder or cylinders" are synonyms since both are elongated member with a circular cross-section, the only distinctions in the present context being that the drying cylinders are generally much larger in diameter than the felt rolls and are heated by appropriate means that are well known in the art. The segregated use of the terms in the text is only for the purpose of clarity. The "cylinder or cylinders" are sometimes referred to as "drum or drums" in other documents.

Traditional drying cylinders and felt roll arrangements feature the felt roll being positioned intermediate the axis of rotation of adjacent drying cylinders, thus halfway between two adjacent drying cylinders. Inherent in these arrangements is the fact that the paper web is repetitively unsupported wherever the felt separates from the paper web to pass over a felt roll.

In order to increase the speed of papermaking machines, it was desirable to reduce the length of unsupported paper web because of the risks of rupture thereof, particularly near the wet end where the paper web is weaker. One solution to this problem was to move the axis of rotation of the felt rolls backwards, more particularly towards the wet end of the machine, as illustrated in FIG. 1. This offset configuration has resulted in the felts and the paper web being in contact longer, thus minimizing the length of unsupported paper web as it travels from one drying cylinder to another.

The offset configuration of the felt rolls has also resulted in creating what is known as offset pockets. In FIG. 1, the pocket spaces (12) are identified as hatched areas. Each pocket space (12) is situated between three successive drying cylinders (20) over which consecutively run a paper web (14). There are thus many offset pockets, such as top pocket (12*a*) and bottom pocket (12*b*) since there are many groups of three successive drying cylinders (20). A pocket space (12) may be roughly defined as the space limited by a felt (16) between two successive drying cylinders (20) of a same row, a first draw of paper web (14) from a first drying cylinder (20) to the next drying cylinder (20) of the other row, a second draw of paper web (14) between that second drying cylinder (20) and a third successive drying cylinder (20) on the same row as the first one, and the free surface of the second drying cylinder (20). The pocket spaces (12) are only open at each side of the machine. It should be noted that the pocket ventilators have been omitted from FIG. 1 for to simplify the drawing.

An offset pocket space (12) is situated between each group of three axially-parallel drying cylinders (20) over which consecutively runs the paper web (14). Among these cylinders (20), the first and third ones (20*a*, 20*c*) are vertically spaced from the second one (20*b*), as shown in FIG. 1. This is due to the fact that there are usually two superposed rows of cylinders (20) in a papermaking machine, more particularly a lower row and an upper row. Since the paper web (14) follows a serpentine or zigzag path across the drying section, there is a plurality of successive pocket spaces (12) in a papermaking machine. The first and third cylinders (20*a*, 20*c*) of a given group will be either on the lower or upper row, while the second cylinder (20*b*) belongs to the opposite row.

The paper web (14) is pressed against the corresponding first (20*a*) and third (20*c*) cylinders by a felt (16) which further runs over a felt roll (26) having a rotation axis which is parallel to that of the cylinders. The felt roll (26) is disposed between the set of three cylinders in an offset position, more particularly in a position which is closer to the first cylinder (20*a*) than the third cylinder (20*c*), as shown in FIG. 1.

Unfortunately, ventilating offset pocket spaces is more difficult than in symmetrical pockets spaces configurations. This results from the reduction of the length of felt which does not support the paper web on the side upstream of the felt roll. Since the felt is permeable to air and the paper web is not, the conventional dry heated air ventilators which were hitherto provided to ventilate the felt cannot be used the same way since air cannot be blown through the felt when it is supporting the paper web. All of this has resulted in decreased air flow into offset pocket spaces, thus a decrease in the efficiency of the ventilation.

An example of a pocket ventilator previously known in the art is disclosed in U.S. Pat. No. 5,074,278. It illustrates a traditional symmetrical arrangement of pocket spaces. This patent is hereby incorporated by reference.

The geometry of a pocket and the natural air currents generated in the pocket space by the moving paper web and felt, as well as the rotation of the drying cylinders and the felt rolls, are key factors which increase the difficulty in ventilating a pocket space. Air introduced in a pocket space has a natural tendency to follow the movement of the felt and also tends to be trapped in a cleft defined by the felt and a downstream drying cylinder. This cleft, known as the closing nip, is a zone of positive air pressure where air tends to flow through the felt to evacuate the pocket space. Furthermore, a zone of negative air pressure is created in a cleft defined where the paper web leaves the felt roll on its way to the next drying cylinder. Some air evacuates the pocket space to satisfy the negative pressure created therein at the opening nip. However, these natural air currents do not provide an adequate ventilation of the pocket space as they do not effectively sweep the pocket space. As a result, air becomes entrapped therein, thereby increasing the humidity level within the pocket space and decreasing the overall drying capacity of the papermaking machine.

U.S. Pat. No. 6,725,569 provides a device for ventilating an offset pocket space as illustrated in FIG. 2. However, trying to introduce air at a first cleft (34), defined where the felt and paper come in contact with the felt roll, is not always desirable as it involves a detachment of the sheet of paper (14) from the felt (16). It appears that introducing air at the first cleft (34) has a tendency to introduce sheet fluttering or sheet instability. To overcome such problem, the operator typically closes the associated internal damper 46A or the air passage at 46A to reduce or cancel the amount of air being introduced by air jet 51 at the first cleft 34.

There is still a need in the art for a pocket ventilator device and method.

SUMMARY OF THE INVENTION

More specifically, in accordance with the present invention, there is provided a device for ventilating an offset pocket space located in a drying section of a papermaking machine, the offset pocket space being situated between three axially parallel drying cylinders over which a paper web consecutively runs, a first and a third of the drying cylinders being vertically spaced from a second of the drying cylinders, the paper web being pressed against the first and the third drying cylinders by a felt which further runs over a felt roll having a rotation axis parallel to a rotation axis of the drying cylinders, the felt roll being disposed between the three drying cylinders in an offset position which is closer to the first drying cylinder than the drying third cylinder, the offset pocket space being delimited by a first cleft defined where the felt and the paper web come in contact with the felt roll, a first draw of the paper web from the first cleft to the second cylinder, a free portion of the second drying cylinder, a second draw of the paper web from the second drying cylinder to a second cleft defined where the felt and the paper web rejoin, and the felt between the first cleft and the second cleft, the device comprising an elongated body extending between the first and third drying cylinders, the body comprising a first plenum chamber receiving heated air from the blower, a second plenum chamber in fluid communication with the first plenum chamber, a third plenum chamber in fluid communication with the second plenum chamber, a fourth plenum chamber separated from the third plenum chamber by a first solid wall and in fluid communication with the second plenum chamber, the fourth plenum chamber having a second wall opposite the first wall and facing the felt passing from a third cleft, defined where the felt leaves the felt roll towards the third cylinder to the second cleft, a series of blowing holes provided in the second wall and supplying hot dry air over the surface of the felt between the third and the second clefts, a first air outlet fed from the second chamber and from which a first air stream is directed on the surface of the felt between the first drying cylinder and the first cleft; the first air stream being in a direction which is substantially opposite a running direction of the felt; wherein the first air stream establishes a negative pressure zone between the first drying cylinder and the first cleft and the series of blowing holes supplying hot dry air creates a positive pressure zone between the third cleft and the second cleft.

There is further provided a device for ventilating an offset pocket space located in a drying section of a papermaking machine, the offset pocket space being situated between three axially parallel drying cylinders over which a paper web consecutively runs, a first and a third of the drying cylinders being vertically spaced from a second of the drying cylinders, the paper web being pressed against the first and the third drying cylinders by a felt which further runs over a felt roll having a rotation axis parallel to a rotation axis of the drying cylinders, the felt roll being disposed between the three drying cylinders in an offset position which is closer to the first drying cylinder than the drying third cylinder, the offset pocket space being delimited by a first cleft defined where the felt and paper come in contact with the felt roll, a first draw of the paper web from the first cleft to the second cylinder, a free portion of the second drying cylinder, a second draw of the paper web from the second drying cylinder to a second cleft defined where the felt and the paper web rejoin, and the felt between the first cleft and the second cleft, the device comprising an elongated body extending parallel to and between the first and third cylinders, the body enclosing at least one plenum chamber; a first air outlet from which a first air stream is directed over the surface of the felt between the first drying cylinder and the first cleft; a second distributed air outlet supplying dry hot air through a surface of the felt between a third cleft and the second cleft, the third cleft being defined where the felt leaves the felt roll towards the second drying cylinder; wherein the first air stream establishes a negative air pressure zone between the first drying cylinder and the first cleft, and the second distributed air outlet creates a positive pressure zone between the third cleft and the second cleft.

There is further provided a method for ventilating an offset pocket space located in a drying section of a papermaking machine, the offset pocket space being situated between three axially parallel drying cylinders over which a paper web consecutively runs, a first and a third of the drying cylinders being vertically spaced from a second of the drying cylinders, the paper web being pressed against the first and the third drying cylinders by a felt which further runs over a felt roll having a rotation axis parallel to a rotation axis of the drying cylinders, the felt roll being disposed between the three drying cylinders in an offset position which is closer to the first drying cylinder than the drying third cylinder, the offset pocket space being delimited by a first cleft defined where the felt and paper come in contact with the felt roll, a first draw of the paper web from the first cleft to the second cylinder, a free portion of the second drying cylinder, a second draw of the paper web from the second drying cylinder to a second cleft defined where the felt and the paper web rejoin, and the felt between the first cleft and the second cleft, the method comprising creating a positive pressure zone between the body and the felt between the third cleft and the second cleft.

Other objects, advantages and features of the present invention will become more apparent upon reading of the following non-restrictive description of specific embodiments thereof, given by way of example only with reference to the accompanying drawings.

DESCRIPTION OF EMBODIMENTS OF THE INVENTION

Figure 1:
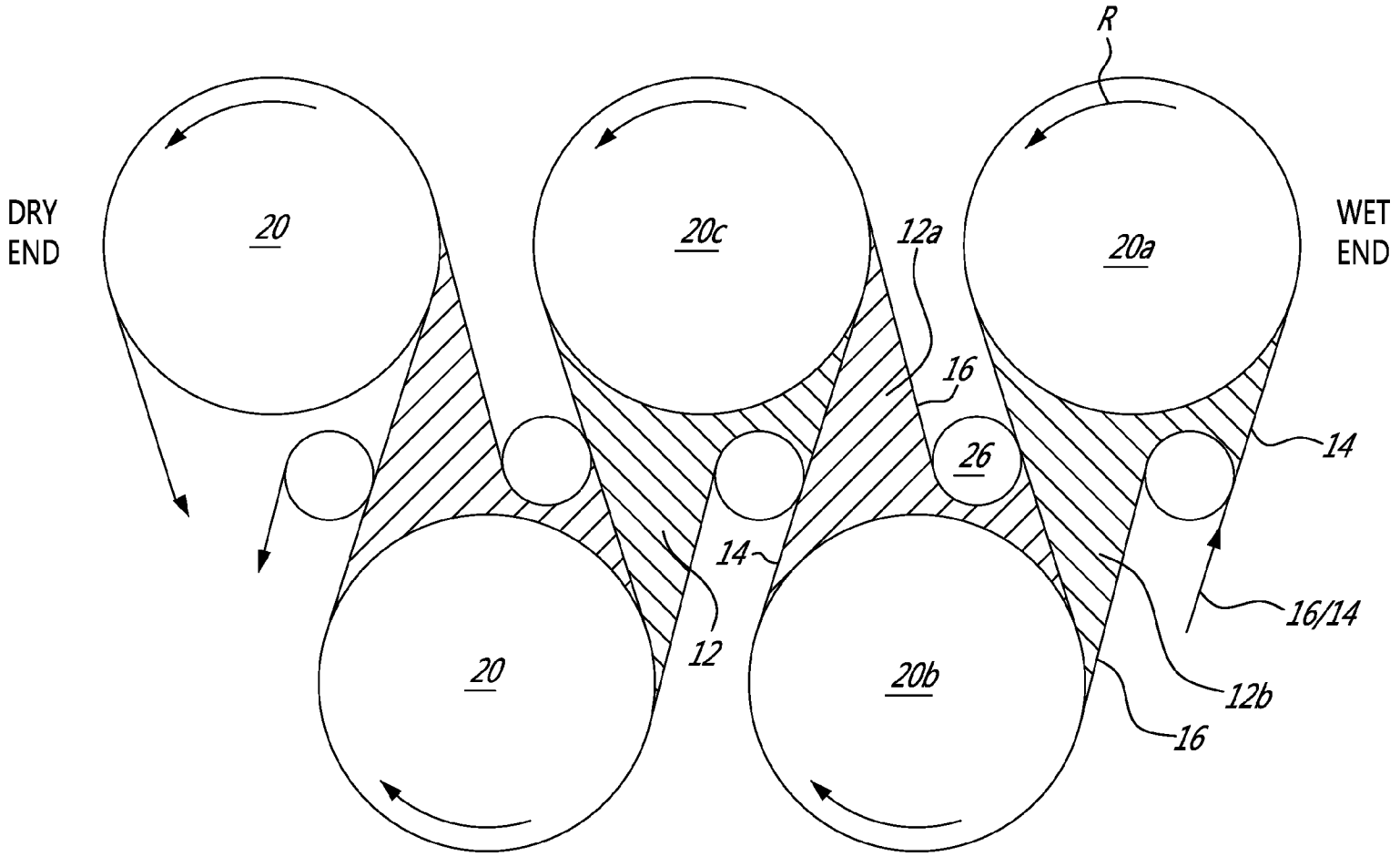
FIG. 1 (PRIOR ART)
FIG. 1 is a schematic side view of a drying section of a papermaking machine as found in the prior art, illustrating an example of a twin-draw arrangement and the location of offset pockets.
Figure 2:
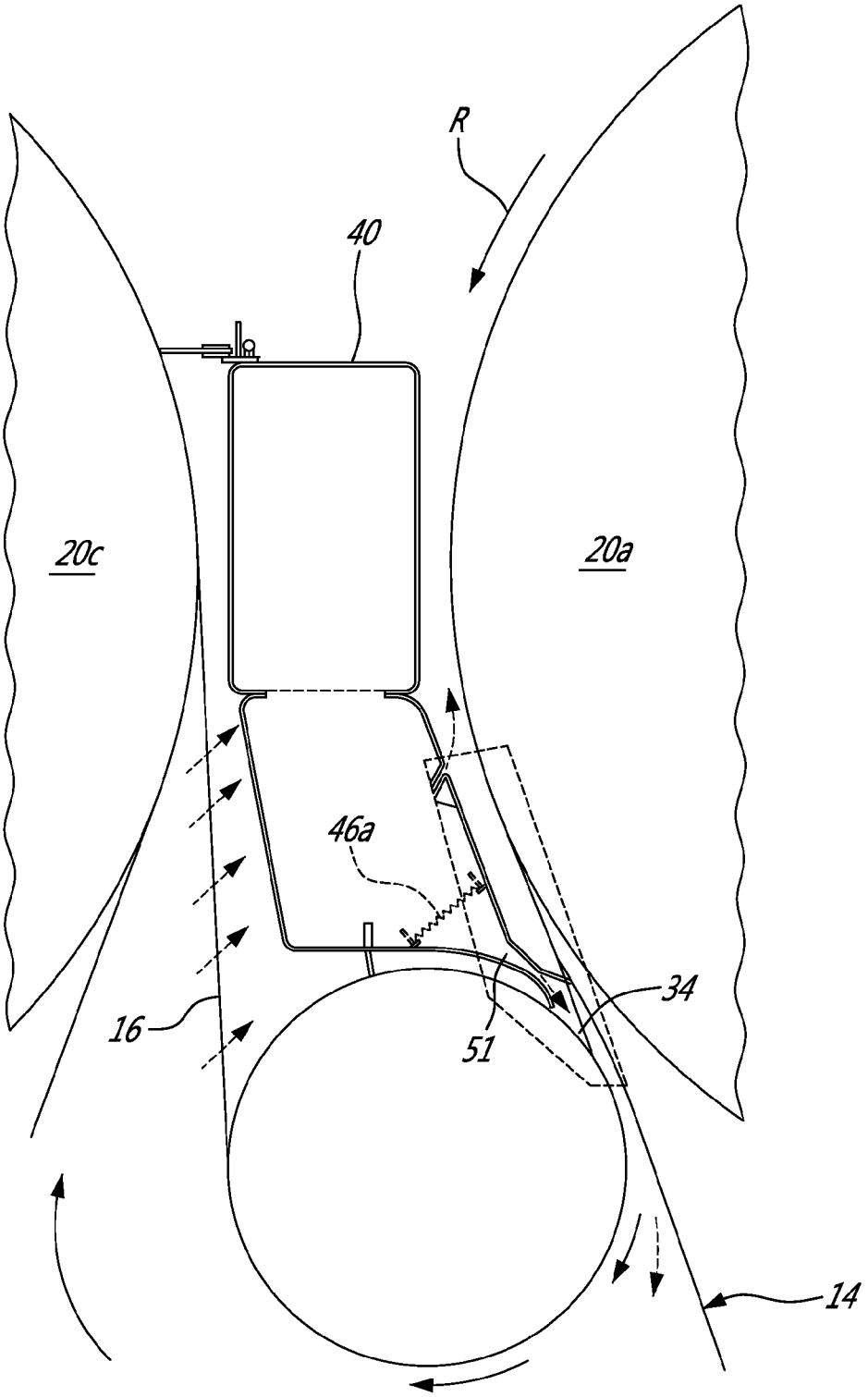
FIG. 2 (PRIOR ART)
FIG. 2 is an enlarged side view of a device for pocket ventilation as found in the prior art.
Figure 3:
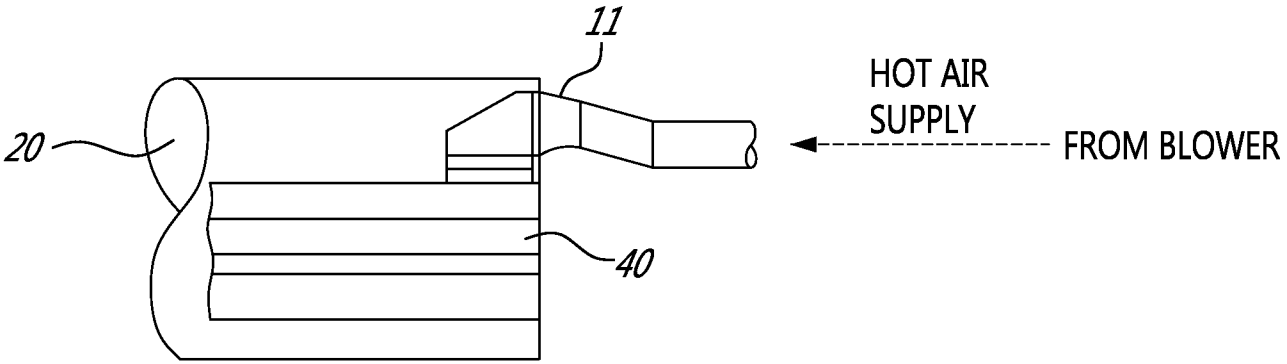
FIG. 3 is a schematic view of a portion of a cylinder and of a device according to an embodiment of an aspect of the present invention, showing an example of how the device is connected to the air duct network.
Figure 4:
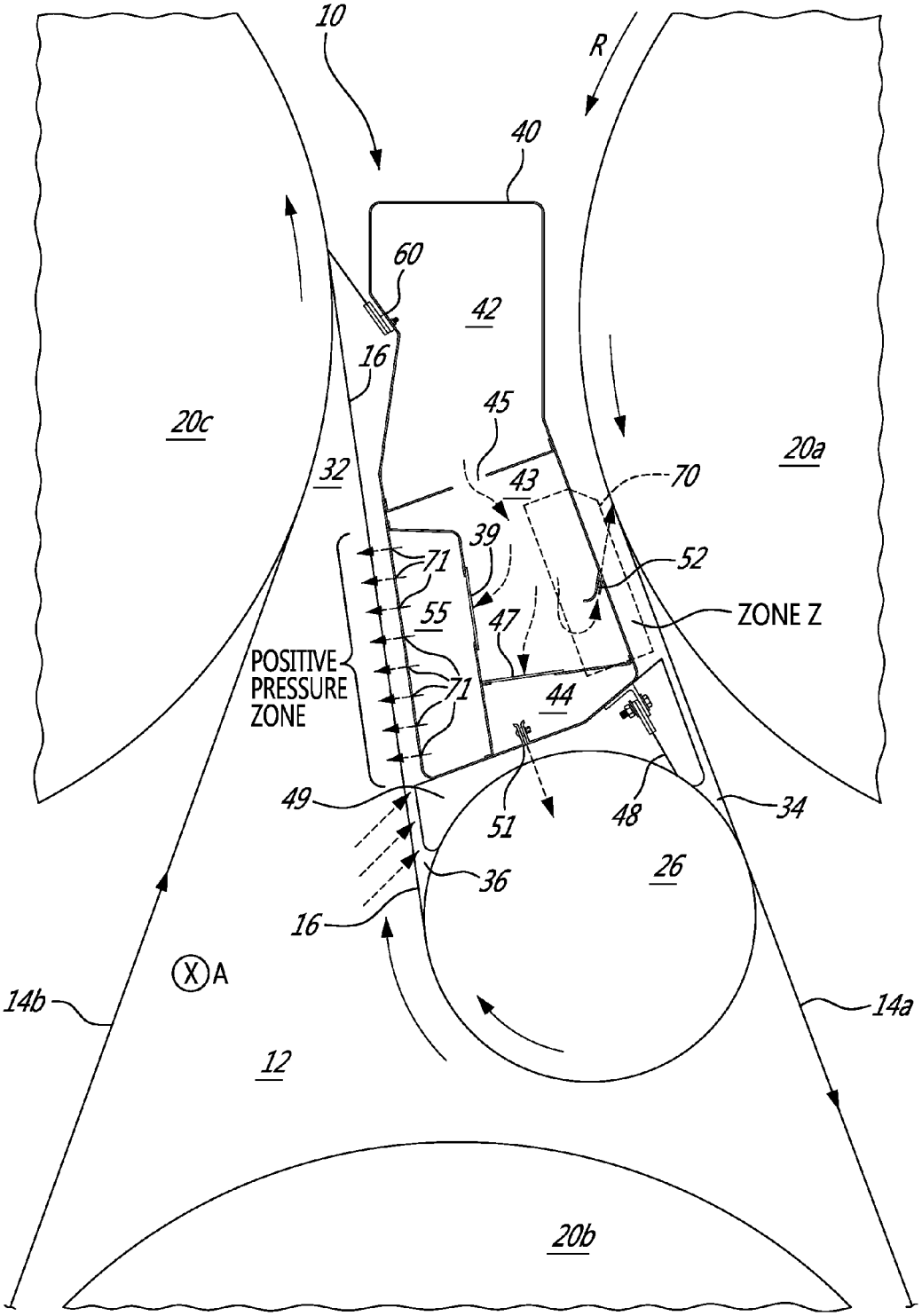
FIG. 4 is an enlarged side view of a device according to an embodiment of an aspect of the present invention, when located in a top pocket.

As illustrated in FIG. 4, the device (10) is used for ventilating an offset pocket space (12) located in a drying section of a papermaking machine in which a paper web (14*a, b*) to be dried travels. The device (10) essentially provides heated dry air through air ducts from a conventional heated dry air supply inlet (11), as schematically represented in FIG. 3, showing an extremity of the device (10). Typically, ambient air is heated and provided through the air duct network by a blower. Proper ventilation of the offset pocket space (12) is achieved by injecting heated dry air in sufficient quantity so as to lower the humidity level and maximize water evaporation from the humid components, particularly the paper web (14).

The offset pocket space (12) is situated between three axially-parallel drying cylinders or drying cylinders (20*a*, 20*b* and 20*c*) over which the paper web (14) consecutively runs.

The offset pocket space (12) is delimited by a first cleft (34) defined where the felt (16) and the paper web (14) come in contact with the felt roll (26), a first draw (14*a*) of the paper web (14) between the first cleft (34) and the second cylinder (20*b*), a free portion of the second cylinder (20*b*) where there is no paper web or felt, a second draw (14*b*) of the paper web (14) from the second cylinder (20*b*), and a second cleft (32) defined where the felt (16) and the paper web (14) rejoin, and the felt (16) from the third cleft 36 to the second cleft (32) returns in contact with the third cylinder (20*c*). The felt (16) is in contact with the felt roll (26) between the first cleft (34) and a third cleft (36) defined where the felt (16) leaves the felt roll (26) towards the third cylinder (20*c*) (See FIG. 4).

Under normal conditions, the sheet of paper (14) leaving a drying cylinder (20) has a tendency to follow the surface of the drying cylinder (20) rather than the felt (16); when following the drying cylinder (20), even for a very short distance, the sheet of paper (14) eventually leaves the surface of the drying cylinder (20), in an uncontrolled fashion, to follow its path, thereby introducing sheet instability and introducing stresses in the sheet (14).

The device (10) comprises an elongated hollow body (40) extending between the first and third cylinders (20*a*, 20*c* in FIG. 4). It extends substantially along the entire length of the cylinders (20*a*, 20*b*, 20*c*), more particularly from one side of the assembly to another.

Figure 6:
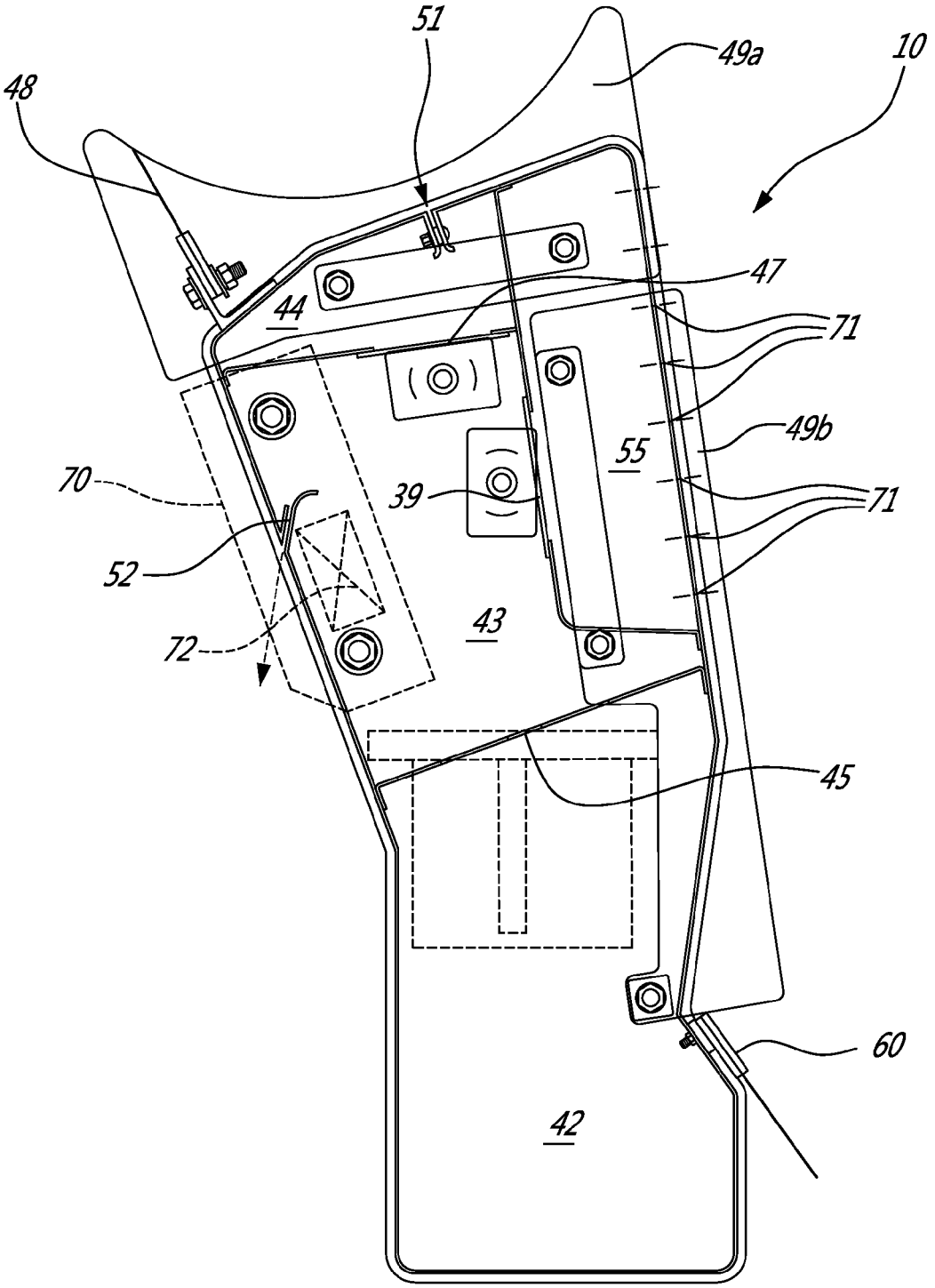
FIG. 6 is an enlarged side view a device according to an embodiment of an aspect of the present invention, when located in a bottom pocket.
Figure 7:
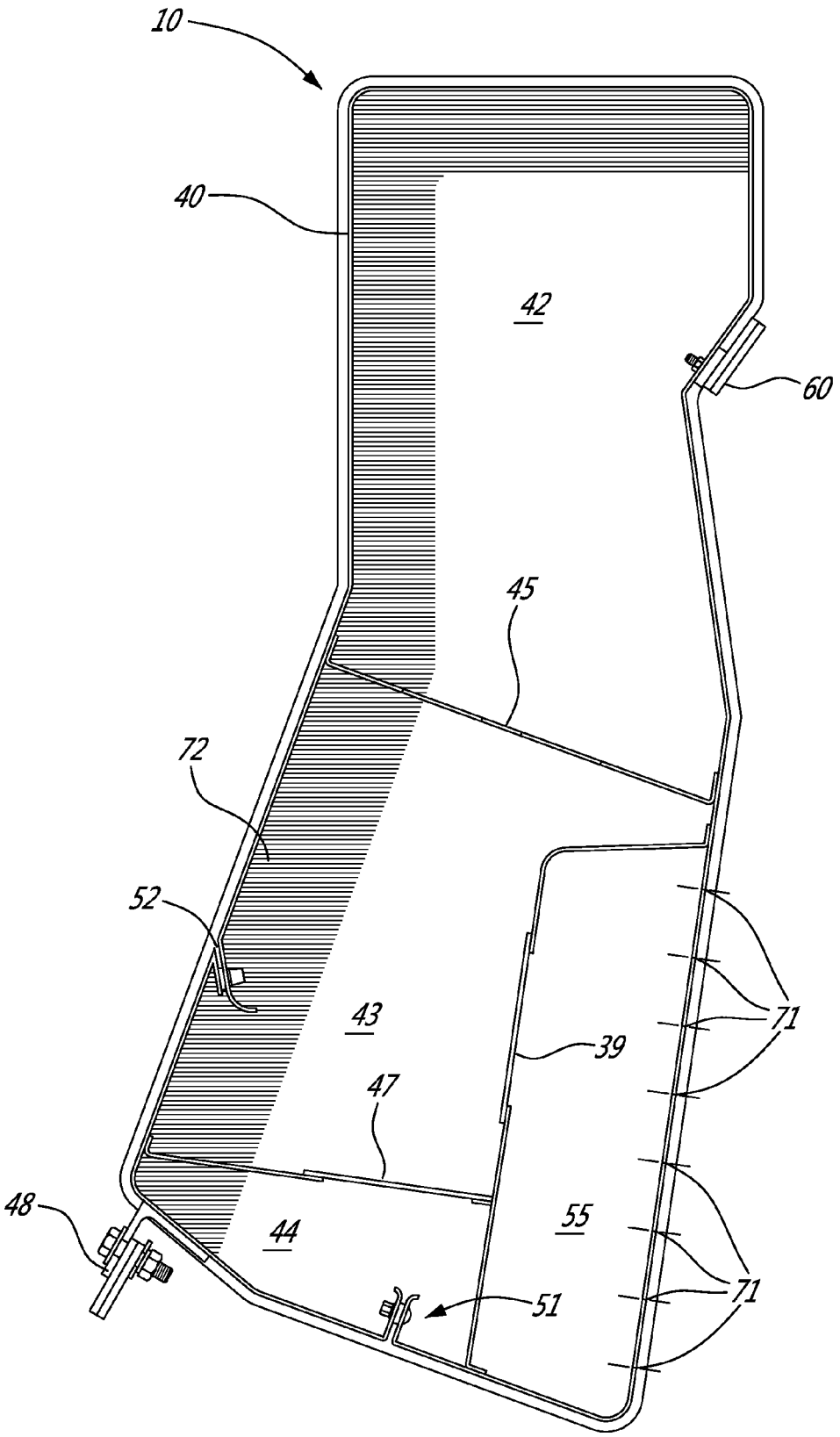
FIG. 7 shows details of a device according to an embodiment of an aspect of the present invention.

In the embodiment illustrated in FIGS. 4, 6, 7, the body (40) comprises a first plenum chamber (42) and a second plenum chamber (43) physically separated by an air diffuser, such as a perforated plate (45). A third plenum chamber (44) is separated from the second plenum chamber (43) by at least one perforated plate or a sliding perforated plates arrangement (47), i.e. for example a set of superposed perforated plates, one of the plate being movable with reference to the other(s), thereby allowing to adjust the flow of air by shifting the position of the movable plate, thus moving its holes out of alignment with the corresponding holes of the other plate(s). A fourth lateral plenum chamber (55), separated from the third plenum chamber (44) by a solid wall, is in fluid communication with the second plenum chamber (43) by at least one perforated plate or a sliding perforated plates arrangement 39 as described hereinabove for example. Other embodiments are possible as well.

The first plenum chamber (42) receives heated air from the blower as described hereinabove in relation to FIG. 3, and the second plenum chamber (43) is the first zone of air distribution, which feeds a first air outlet (52) that provides an air stream at a location upstream of the last contact point between the felt (16) and the first drying cylinder (20*a*), i.e. directed on the surface of the felt (16) between the first drying cylinder (20*a*) and the first cleft (34) (see FIG. 4). This air stream is in a direction which is substantially opposite the running direction (R) of the felt (16) (see FIG. 4).

The air flow within chambers (43) and (55) is controlled by the perforated plate or the sliding perforated plates arrangement 39 as described hereinabove for example.

Figure 10B:
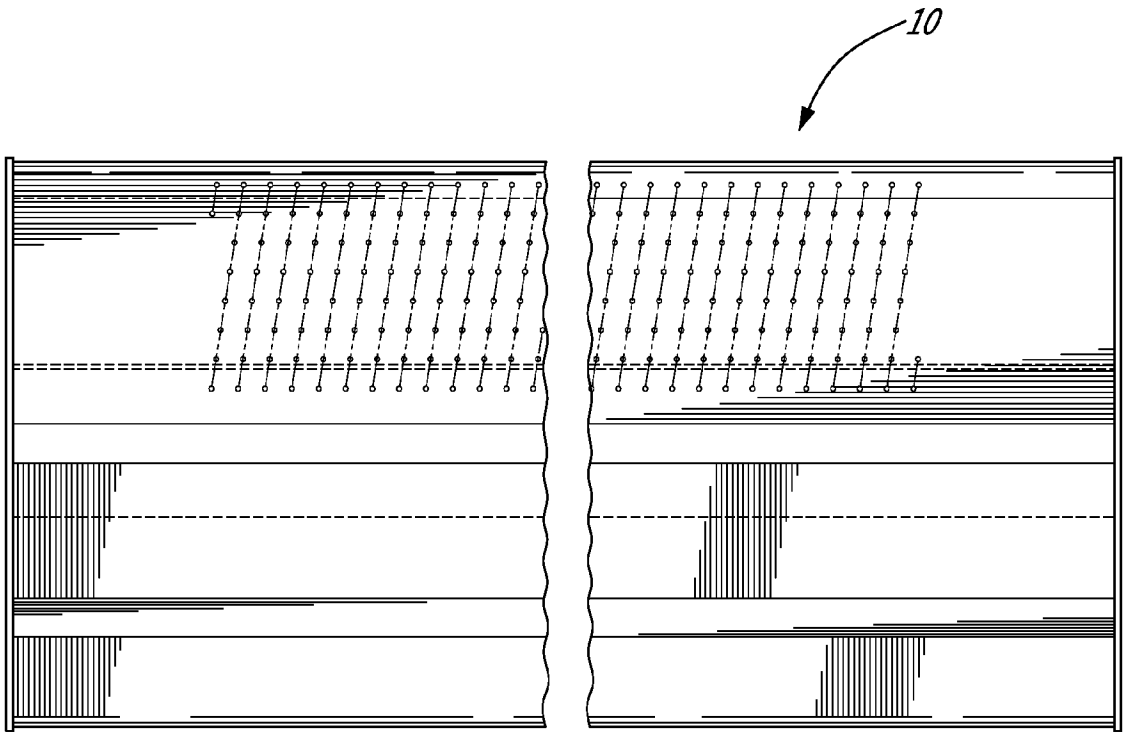
FIG. 10B is an elevation view of a device according to an embodiment of an aspect of the present invention.
Figure 10A:
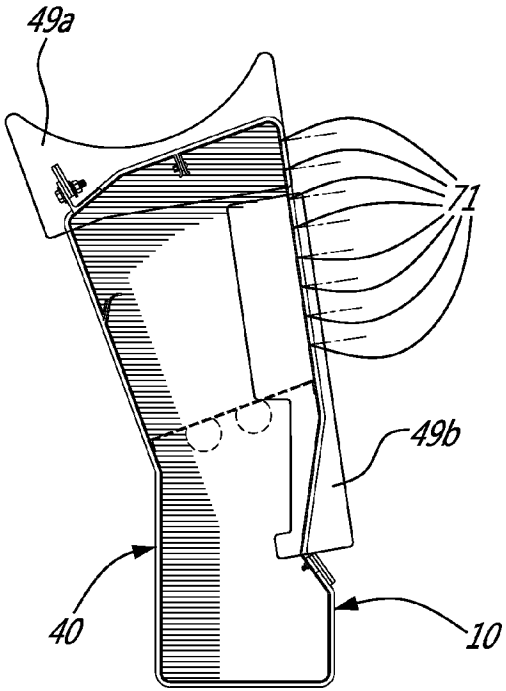
FIG. 10A show details of a device according to an embodiment of an aspect of the present invention.

The wall of the fourth lateral plenum chamber (55) opposite the chambers (43) and (44), i.e. facing the moving felt (16) passing from the third cleft (36) to the second cleft (32), i.e. leaving the pocket (12), comprises a series of blowing holes (71) distributed over its surface, forming a distributed air outlet, thereby promoting an efficient penetration of the hot air supplied from the chamber (55) through the surface of the felt (16) (see FIG. 10), thereby creating a positive pressure zone generally between the third cleft (36) and the second cleft (32).

In the illustrated embodiment, the air outlet (52) is in the form of a full length slot, i.e. a slot extending longitudinally on a side of the device (10) facing the first cylinder (20*a* in FIG. 4) of the group of three cylinders. The slot extends substantially along the entire length of the body (40). It should be noted that the term "slot" also covers the case where the device (10) has a set of consecutive slots or similar structures that are closely spaced to one another. Various other means may also be added to control or adjust the air flow through the first air outlet (52).

Figure 8:
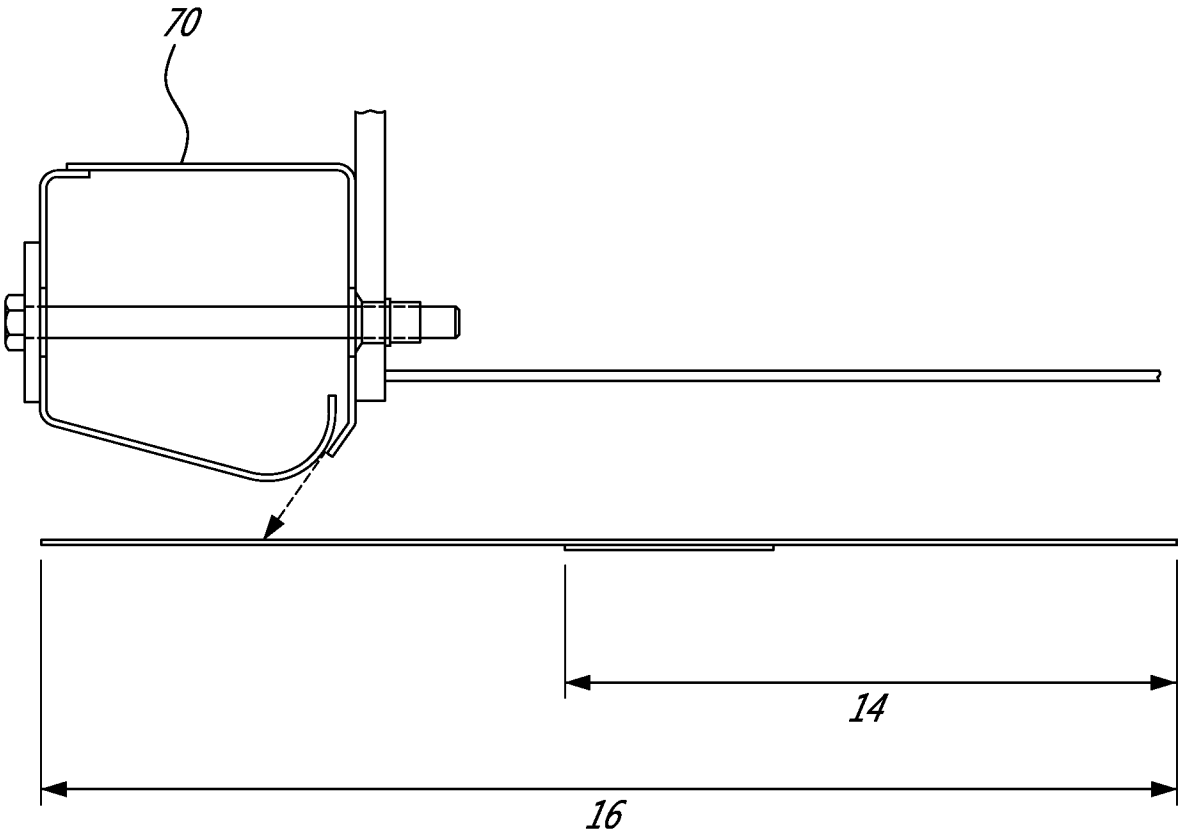
FIG. 8 shows details of a device according to an embodiment of an aspect of the present invention.

In use, the air stream from the first air outlet (52) establishes a negative air pressure (zone Z) at a location of the last contact point between the felt (16) and the first drying cylinder (20*a*) (see FIG. 4), immediately upstream of the first cleft (34). A blowing end seal (70), bolted to the second plenum chamber (43) at the end of the device (10) for example, works in conjunction with the air outlet (52), by providing air from the second plenum chamber (43) through an opening (72) (best seen in FIG. 6) to help generating the negative pressure zone (zone Z) (see FIGS. 6, 8), in order to maintain a desired tight contact between the sheet (14) and the felt (16) until they reach the first cleft (34) or the felt roll (26).

A second air outlet (51) from the third plenum chamber (44) may be provided to blow a stream of new air directly on the felt roll (26) in order to heat the surface of the felt roll (26) and prevent water condensation that may occur on the felt roll (26), in case of corrosion problems on the felt roll (26) for example. The second air outlet (51) may also help pressurizing the space between the ventilator (40) and felt roll (26). The amount of air blown by this second optional outlet (51) may be controlled with a sliding perforated plates arrangement as described hereinabove. Other embodiments are possible as well. In cases when there are no condensation problems, this second air outlet (51) may be omitted.

A first mechanical seal 49*a*, such as sealing strip, is provided between the body (40) and the felt roll (26) (see FIGS. 6 and 9), thereby creating a barrier protecting the reduced air pressure (zone Z) from air that may be blown from the second air outlet (51) directly on the felt roll (26). The mechanical seal (49*a*) also seals the end of the zone Z below the blowing end seal 70, which cannot practically be extended all the way to the first cleft (34).

A second mechanical seal (48), such as a blade sealing strip, in a polymer or stainless steel for example, is provided between the body (40) and the felt roll (26) close to the first cleft (34). This mechanical seal (48) prevents hot air entrained by the felt roll (26) to reach the first cleft 34, thereby contributing into maintaining the negative pressure zone (zone Z) and keeping it as leak tight as possible. Moreover, it also delimits the negative air pressure (zone Z).

The exposed felt surface (16) moving at high velocity from the felt roll (26) at the third cleft (36) to the following drying cylinder (20*c*) at the second cleft (32) (see left hand side of FIG. 4 for example) generates a pumping effect sucking air out of the pocket (12) through the felt (16) and more so at the third cleft (36) which is naturally under negative pressure and thus tends to extract air out of the pocket. When the amount of air being pumped out of the pocket (12) in this way is larger than the amount of air originally being introduced therein through the felt over the positive pressure zone created by the blowing holes (71) (see left handside of FIG. 4 for example), it creates an unbalanced negative pocket of air flow that generates an axial air flow into the pocket (see (X)A in FIG. 4), compensating for the smaller amount of air being pumped into the pocket (12), this axial airflow creating unstability of the paper web (14*b*).

Figure 5:
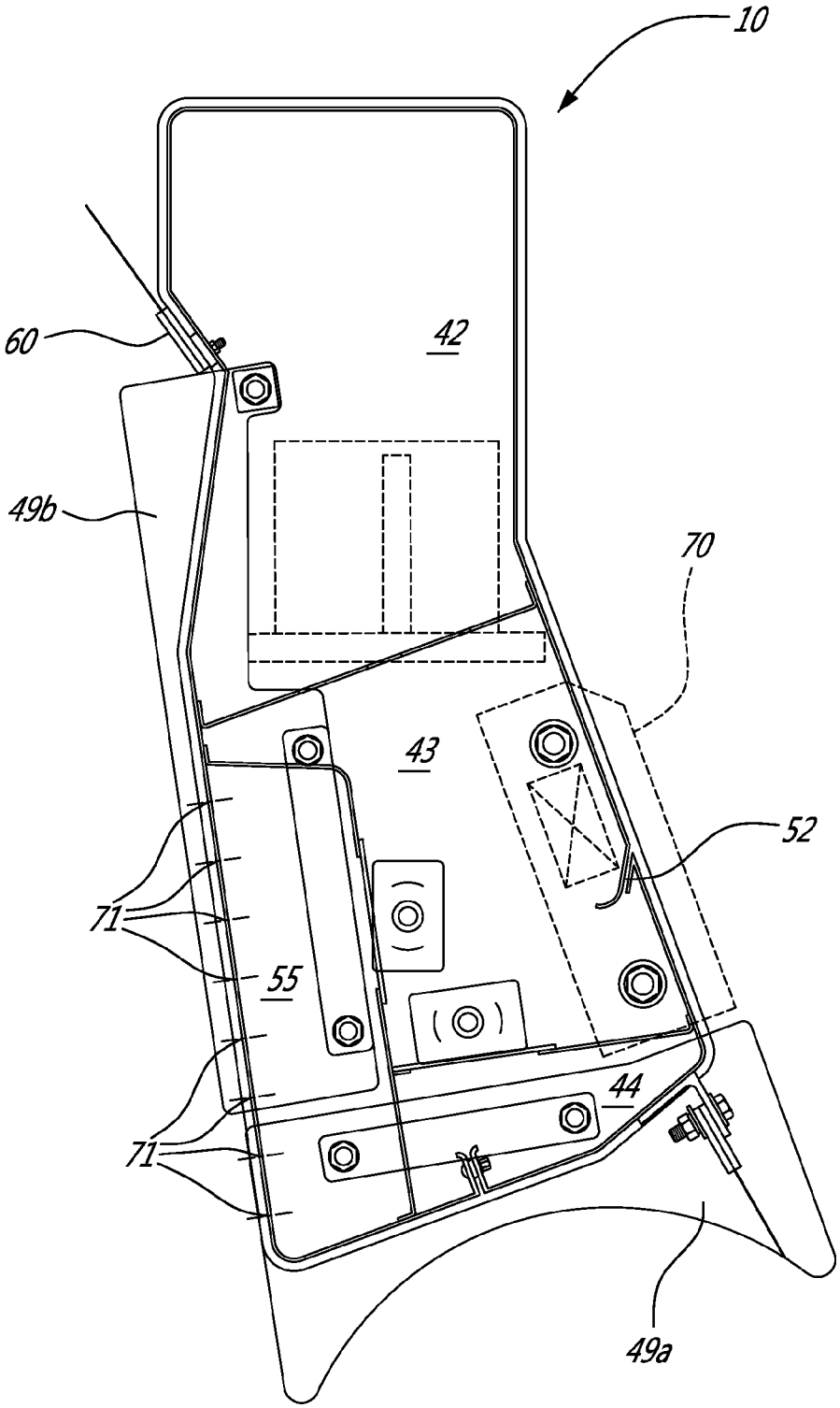
FIG. 5 shows details of the device of FIG. 4.

The positive pressure zone, shown for example in FIGS. 4 and 5, is created between the body (40) and the felt (16), generally between the third cleft (36) and the second cleft (32), over the surface of the felt (16) by the flow of air out of the blowing holes (71). This positive pressure zone effectively introduces hot air into the pocket (12) through the felt (16). This air partially neutralizes the pumping effect of the felt (16) described above and helps balancing the pocket (12) by adding hot air.

Figure 9B:
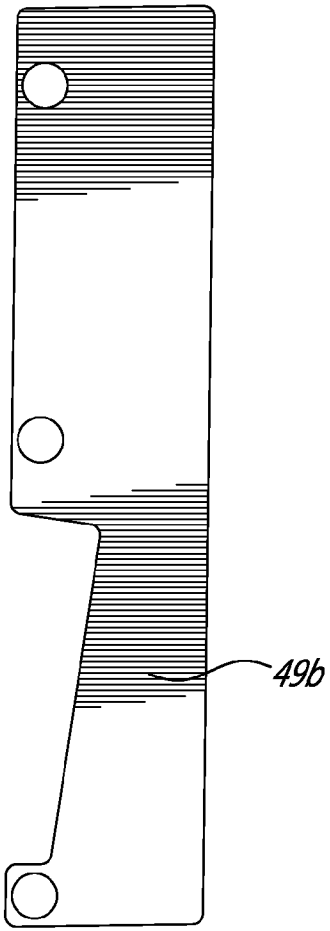
FIG. 9B shows a detail of a device according to an embodiment of an aspect of the present invention.
Figure 9A:
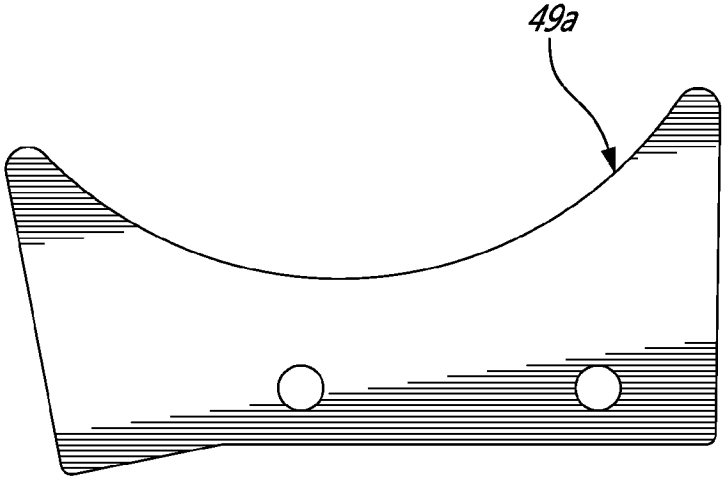
FIG. 9A shows a details of a device according to an embodiment of an aspect of the present invention.

A third mechanical seal (49*b*), shown for example in FIGS. 5 and 9, is provided, generally extending from the first seal (49*a*) to a seal (60) discussed hereinbelow, to secure the positive pressure zone created generally between the third cleft (36) and the second cleft (32).

The mechanical seals (49*a*) and (49*b*), located at each extremity of the device (10) (see FIG. 10A and FIG. 10B), provide a seal between the device (10), the felt roll (26) and the felt (16), as described hereinabove.

Thus, the paper web (14) is maintained on the felt (16) as long as possible as it leaves the dryer (20*a*) and the paper web (14) is stabilized and the risks of fluttering are reduced by provision of the negative pressure zone (zone Z) at a location which is immediately upstream the first cleft (34), contributed to by the air outlet (52) and the blowing end seal (70). Moreover, the air pocket balance is maintained by provision of the positive pressure zone between the third cleft (36) and the second cleft (32).

The provision a plenum chamber (55) having a wall perforated with blowing holes (71) and of sliding perforated plates arrangements (39), (47) for example, acting as dampers, allows an effective control of the amount of air being introduced into the pocket, and therefore an enhanced control of the air balance of the pocket.

To help control the amount of air being pumped out of the pocket by the felt movement, for a still further enhanced control of the air balance of the pocket (12), it is possible to restrict the air flow by creating an air flow restriction at a location of the third cylinder (20*c*) over which the felt (16) runs, which location is immediately above the surface of the cylinder (20*c*) and downstream of the second cleft (32). Air flow restriction may be realized by an elongated mechanical seal (60) projecting from an outer portion of the body (40) towards a location on the third cylinder (20*c* in FIG. 4) where the felt runs thereon. The seal (60) does not necessarily extend over the entire length of the third cylinder (20*c*) but is at least placed where the pumping effect is the strongest, i.e. generally in an area located close to the midpoint over the length of device 10.

The present device and method allows maximizing the stability of the sheet of paper (14), by forcing the paper (14) to stay in contact with the felt (16) as it leaves the drying cylinder (20*a*) and balancing the air flow into and out of the pocket (12) to minimize any axial airflow which is detrimental to the stability of the sheet of paper (14), as well as ventilating, i.e. creating an air change within, the pocket (12), to thereby promote drying.

The present device promotes a continuous contact between the felt (16) the sheet of paper (14) from the point where they leave the first drying cylinder (20*a* in FIG. 4) to getting on the felt roll (26), in contrast to devices that introduce air at the first cleft (34), thereby causing a lifting effect of the sheet of paper (14) from the felt (16) before penetrating the pocket (12).

The present method and system provide effectively supplying enough hot dry air into the pocket thru the exposed felt surface between clefts (36) and (32) to balance the air naturally leaving the pocket.

Cleft (36) is a negative pressure cleft pumping air out of the pocket and cleft (32) is a positive pressure cleft also pumping air out of the pocket. The exposed felt run located between cleft (36) and (32) is also a zone where the air is naturally extracted out of the pocket by natural air movement and pumping effect of the felt. That makes the pocket under a negative air balance with more air being extracted and no air being introduced.

The present method and system provide a positive pressure zone created by a distributed supply of hot dry air over a large surface of the exposed felt between clefts (36) and (32). The addition of this positive pressure zone cancels the natural pumping effect of the felt promoting air extraction from the pocket and replaces it with a positive pressure zone promoting air penetration into the pocket thru the felt.

The extended positive pressure zone created by a multitude of blowing holes spread over almost the entire exposed felt surface between clefts 36 and 32 is effective because it extends over a large surface of the felt. Moreover, using a multitude of blowing orifices is found to be most effective in promoting air penetration thru the felt.

The blowing end seal (70) contributes to maintaining the negative pressure zone Z over the entire surface of the felt between the drying cylinder (20*a*) and the cleft (34), especially near the extremities of the device (10).

Air outlet (51) may be provided for blowing air onto the felt roll to eliminate the risks of condensation. The air outlet (51) may also contributes to pressurizing the area located between the felt roll (26), the elongated body (10) and the mechanical seal (48) to help neutralizing the pumping effect of the negative pressure cleft (36) trying to extract air out of the pocket thus contributing to a better pocket air balance The scope of the claims should not be limited by the embodiments set forth in the examples, but should be given the broadest interpretation consistent with the description as a whole.

The invention claimed is:

1. A device for ventilating an offset pocket space located in a drying section of a papermaking machine, the offset pocket space being situated between three axially parallel drying cylinders over which a paper web consecutively runs, a first and a third of said drying cylinders being vertically spaced from a second of said drying cylinders, the paper web being pressed against the first and the third drying cylinders by a felt which further runs over a felt roll having a rotation axis parallel to a rotation axis of said drying cylinders, said felt roll being disposed between the three drying cylinders in an offset position which is closer to the first drying cylinder than the drying third cylinder, the offset pocket space being delimited by a first cleft defined where the felt and the paper web come in contact with the felt roll, a first draw of the paper web from the first cleft to the second cylinder, a free portion of the second drying cylinder, a second draw of the paper web from the second drying cylinder to a second cleft defined where the felt and the paper web rejoin, and the felt between the first cleft and the second cleft, the device comprising an elongated body extending between the first and third drying cylinders, said body comprising:

a first plenum chamber receiving heated air from a blower;

a second plenum chamber in fluid communication with said first plenum chamber;

a third plenum chamber in fluid communication with said second plenum chamber;

a fourth plenum chamber separated from said third plenum chamber by a first solid wall and in fluid communication with said second plenum chamber, said fourth plenum chamber having a second wall opposite said first wall and facing the felt passing from a third cleft, defined where the felt leaves the felt roll towards the third cylinder to the second cleft;

a series of blowing holes provided in a second wall and supplying hot dry air over the surface of the felt between the third and the second clefts;

a first air outlet fed from said second chamber and from which a first air stream is directed on a surface of the felt between the first drying cylinder and the first cleft; said first air stream being in a direction which is substantially opposite a running direction of the felt;

wherein said first air stream establishes a negative pressure zone between the first drying cylinder and the first cleft and said series of blowing holes supplying hot dry air creates a positive pressure zone between the third cleft and the second cleft.

2. The device according to claim 1, further comprising a blowing end seal providing air from said second plenum chamber to maintain the negative pressure zone over the surface of the felt between the first drying cylinder and the first cleft.

3. The device according to claim 1, further comprising a second air outlet blowing a stream of air from the third plenum chamber directly on the felt roll.

4. The device according to claim 1, further comprising at least one mechanical seal between the body and the felt roll to seal the negative pressure zone.

5. The device according to claim 1, wherein said first air outlet is a slot extending longitudinally on a side of the device facing the first drying cylinder.

6. The device according to claim 1, further comprising at least one mechanical seal to seal the positive pressure zone.

7. The device according to claim 1, further comprising an air flow restriction above a surface of the third drying cylinder downstream of the second cleft.

8. The device according to claim 1, comprising a first air diffuser between the first chamber and the second chamber, a second air diffuser between the second chamber and the third chamber, a third air diffuser between the second chamber and the fourth chamber.

9. A device according to claim 1, wherein the device extends substantially along the entire length of the drying cylinders.

10. A device for ventilating an offset pocket space located in a drying section of a papermaking machine, the offset pocket space being situated between three axially parallel drying cylinders over which a paper web consecutively runs, a first and a third of said drying cylinders being vertically spaced from a second of said drying cylinders, the paper web being pressed against the first and the third drying cylinders by a felt which further runs over a felt roll having a rotation axis parallel to a rotation axis of said drying cylinders, said felt roll being disposed between the three drying cylinders in an offset position which is closer to the first drying cylinder than the drying third cylinder, the offset pocket space being delimited by a first cleft defined where the felt and paper come in contact with the felt roll, a first draw of the paper web from the first cleft to the second cylinder, a free portion of the second drying cylinder, a second draw of the paper web from the second drying cylinder to a second cleft defined where the felt and the paper web rejoin, and the felt between the first cleft and the second cleft, the device comprising:

an elongated body extending parallel to and between the first and third cylinders, the body enclosing at least one plenum chamber;

a first air outlet from which a first air stream is directed over a surface of the felt between the first drying cylinder and the first cleft;

a second distributed air outlet supplying dry hot air through a surface of the felt between a third cleft and the second cleft, said third cleft being defined where the felt leaves the felt roll towards the second drying cylinder;

wherein said first air stream establishes a negative air pressure zone between the first drying cylinder and the first cleft, and said second distributed air outlet creates a positive pressure zone between the third cleft and the second cleft.

11. A method for ventilating an offset pocket space located in a drying section of a papermaking machine, the offset pocket space being situated between three axially parallel drying cylinders over which a paper web consecutively runs, a first and a third of the drying cylinders being vertically spaced from a second of the drying cylinders, the paper web being pressed against the first and the third drying cylinders by a felt which further runs over a felt roll having a rotation axis parallel to a rotation axis of the drying cylinders, the felt roll being disposed between the three drying cylinders in an offset position which is closer to the first drying cylinder than the drying third cylinder, the offset pocket space being delimited by a first cleft defined where the felt and paper come in contact with the felt roll, a first draw of the paper web from the first cleft to the second cylinder, a free portion of the second drying cylinder, a second draw of the paper web from the second drying cylinder to a second cleft defined where the felt and the paper web rejoin, and the felt between the first cleft and the second cleft, the method comprising creating a positive pressure zone between the body and the felt between the third cleft and the second cleft.

12. The method of claim 11, wherein said creating a positive pressure zone between the body and the felt between the third cleft and the second cleft comprises supplying hot dry air over the surface of the felt between the third and the second clefts.

* * * * *